US007291804B2

(12) United States Patent
Suslov

(10) Patent No.: US 7,291,804 B2
(45) Date of Patent: Nov. 6, 2007

(54) PLASMA-SPRAYING DEVICE

(75) Inventor: Nikolay Suslov, Västra Frölunda (SE)

(73) Assignee: Microspray Technologies i Göteborg AB, Mölndal (SE)

( * ) Notice: Subject to any disclaimer, the term of this patent is extended or adjusted under 35 U.S.C. 154(b) by 0 days.

(21) Appl. No.: 10/527,268

(22) PCT Filed: Sep. 17, 2003

(86) PCT No.: PCT/SE03/01455

§ 371 (c)(1),
(2), (4) Date: Oct. 3, 2005

(87) PCT Pub. No.: WO2004/028221

PCT Pub. Date: Apr. 1, 2004

(65) Prior Publication Data

US 2006/0091116 A1 May 4, 2006

(30) Foreign Application Priority Data

Sep. 17, 2002 (SE) ..... 0202752

(51) Int. Cl.
*H05B 10/00* (2006.01)

(52) U.S. Cl. ..... 219/121.47; 219/121.48

(58) Field of Classification Search ..... 219/121.47, 219/121.48, 121.49, 121.44, 121.52, 121.5, 219/75, 76.16, 76.15; 315/111.21, 111.31; 427/570, 569; 313/231.31, 231.41
See application file for complete search history.

(56) References Cited

U.S. PATENT DOCUMENTS 3,149,222 A * 9/1964 Giannini et al. ..... 219/121.44
5,406,046 A * 4/1995 Landes ..... 219/121.47

FOREIGN PATENT DOCUMENTS

| | | |
|---|---|---|
| EP | 1 113 711 A2 | 7/2001 |
| FR | 2 191 394 | 2/1974 |
| JP | 6 251 869 A | 9/1994 |
| WO | WO90/03095 | 3/1990 |

* cited by examiner

*Primary Examiner*—Quang Van
(74) *Attorney, Agent, or Firm*—Harness, Dickey & Pierce, P.L.C.

(57) ABSTRACT

Example embodiments relate to a plasma-spraying device for spraying a powdered material, including electrodes, which may form a plasma channel having an inlet end and an outlet end, and a unit for supplying the powdered material to the plasma channel. The powder supply unit may be arranged between a first section of the electrodes located upstream of the powder supply unit and a second section of the electrodes located downstream of the powder supply, as seen in the direction of plasma flow of the plasma channel.

29 Claims, 5 Drawing Sheets

PLASMA-SPRAYING DEVICE

FIELD OF THE INVENTION

The present invention relates to a plasma-spraying device for spraying a powdered material, comprising electrodes, which form a plasma channel having an inlet end and an outlet end, and a means for supplying said powdered material to said plasma channel. The invention further concerns a method of plasma-spraying. Finally, the invention also concerns the use of a plasma-spraying device for incinerating a powdered material.

BACKGROUND ART

Plasma-spraying devices or plasmatrons are used for low-power thermal spraying of powdered materials, for example in connection with different kinds of surface-coating. Such devices generally comprise a cathode, an anode and a plasma channel formed therebetween. During use of the device an electric arc is generated in the plasma channel, between the anode and the cathode, and gas is then introduced in the plasma channel for forming a plasma. The plasma jet thus flows through the plasma channel from an inlet end adjacent the cathode to an outlet end adjacent the anode. At the same time, a powdered material is supplied to the plasma jet for spraying thereof.

Today, one of two alternatives is used for supplying the powder.

According to the first alternative, the powder is introduced in the outlet area of the plasma channel, adjacent the anode. One advantage of this alternative is that when the powder is supplied the plasma flow is fully developed and has certain determined properties (temperature, velocity, sectional area, energy, etc.). These properties are dependent, inter alia, on the geometry of the plasma channel, the plasma-generating gas used and the amount of energy supplied. A further advantage of supplying the powder at the anode is that the heating of the plasma flow is not affected by the properties of the powdered material.

In connection with this variant of powder supply the powder is usually supplied perpendicularly to the plasma flow. The path of the powder particles travelling out from the anode area towards the surface to be coated will thus depend largely on the size and weight of the particles. The larger and heavier particles enter the high-temperature zone of the plasma jet directly, whereas the lighter ones first reach the centre of the plasma jet only in relatively cold zones located relatively far away from the anode. This means that there is a risk of part of the powder particles not being sufficiently hot and, moreover, of them missing the target, i.e. the object to be coated, for example, with the powdered material.

This is disadvantageous in that a large part of the powdered material is wasted, resulting in poor material economy. In other words, the powder-sprayed coating is produced using only a small part of the powder supplied. This is particularly disturbing when expensive coating materials are being used. The problem can be solved to some extent by using more homogeneous powders. A disadvantage associated with such powders, however, is that they are difficult to manufacture and, thus, relatively expensive.

To avoid problems associated with a perpendicular powder supply at the outlet area of the plasma channel, attempts have been made to provide a supply pipe for horizontal powder supply, which pipe is arranged directly in the plasma jet. However, one disadvantage hereof is that problems arise in connection with the heating of the plasma flow and that the plasma flow properties are greatly interfered with.

A further disadvantage generally associated with the introduction of the powdered material in the anode area, at the outlet of the plasma channel, is that a large amount of energy is needed to maintain the high temperature and specific power (power per unit of volume) of the plasma flow, so as to obtain, in turn, a homogeneous coating. It is believed that this is due to the fact that the plasma flow at the outlet of the plasma-spraying device, where the powder is supplied, has a virtually parabolic temperature and velocity distribution. Thus, the temperature and velocity gradient and the thermal enthalpy of the plasma flow are inversely proportional to the diameter of the plasma jet. To increase the homogeneity of the spray coating it is therefore necessary to increase the diameter of the plasma jet, which requires a lot of energy.

U.S. Pat. Nos. 3,145,287 and 4,445,021 discloses plasma-spraying devices in which the powdered material is introduced in the anode area, at the outlet of the plasma channel.

According to a second known alternative, the powder is supplied at the inlet of the plasma channel, at the cathode. In this case, the powder is heated by the electric arc simultaneously with the plasma-generating gas. The cathode area is considered to be a cold zone, which allows the powder to be introduced in the centre of the plasma flow.

When supplying gas at the cathode area in a plasma channel where an electric arc is generated at a predetermined discharge current, a small part of the gas will flow into the central part of the channel where the temperature is high, while the remaining part of the gas will flow along the channel walls, forming a cold gas layer between the channel walls and the electric arc. By using this gas distribution only a small part of the powder supplied at the inlet will flow into the electric arc, while the large part of the powder will flow in the cold layer adjacent the channel walls. This results in the powder being unevenly heated and the process being difficult to control. Furthermore, the channel and the anode risk being clogged by the powder, which thus has a detrimental effect on the conditions required for a stable plasma flow.

Trying to increase the transfer of mass to the central part of the channel by increasing the gas and powder flow is not a practicable alternative. The reason is that if the gas and powder flow is increased, while the current is kept constant, the diameter of the electric arc will decrease, which aggravates the problem of powder material accumulating in the cold areas along the channel walls. At the same time, the time during which the powder particles that actually end up in the heating zone remain in this zone decreases, since their velocity increases. This further reduces the quality of the process. Therefore, the amount of material in the hot zone cannot be increased if the current remains constant. Increasing the current implies, in turn, disadvantages both for the design and handling of the plasma-spraying device.

U.S. Pat. Nos. 5,225,652, 5,332,885 and 5,406,046 disclose plasma-spraying devices in which the powder is supplied at the cathode.

When analysing plasma-spraying processes, it has been found that the properties of the coating formed mainly depend on the thermal condition and velocity of the powder during spraying. The term "thermal condition" here primarily means the thermal profile and state of aggregation of the material. In prior-art plasma-spraying devices it is difficult, as described above, to control the thermal condition and velocity of the powder.

SUMMARY OF THE INVENTION

The object of the present invention is to provide an improved plasma-spraying device for low-power spraying of powdered materials, which allows satisfactory control of the coating properties as well as good homogeneity. Moreover, the invention shall allow spraying of coatings of materials and compounds with different properties. Finally, it shall also be possible to use the invention for breaking down powdered materials.

According to the invention this object is achieved by means of a device of the kind stated by way of introduction, in which said powder supply means is arranged between a first section of said electrodes located upstream of the means and a second section of said electrodes located downstream of the means, as seen in the direction of plasma flow of the plasma channel from inlet end to outlet end.

Thus, the powdered material is supplied neither at the inlet end (cathode end) nor at the outlet end (anode end) of the plasma channel, but somewhere along the channel, between two sections thereof. Owing to this design, it is possible to control the properties of the plasma flow both before and after the powder has been supplied to the plasma flow and, thus, to control the velocity and heat of the powder particles in such manner that the desired coating properties and good homogeneity can be obtained. Furthermore, the plasma-spraying device according to the invention allows the use of a plasma channel with a relatively small diameter, which results in a low power consumption and low operating currents.

The section located upstream of the powder supply can then suitably be used to create the optimal conditions in the plasma flow, so that the material is heated effectively. The section located downstream of the powder supply allows control of the heating of the powdered material and other characteristics of the powder, such as its velocity. In this manner, high efficiency and satisfactory control of the plasma-spraying process can be obtained.

Preferably, the section located upstream of the powder supply means and the section located downstream of the powder supply means can be designed in such manner that they, when the plasma-spraying device is being used, bring about different conditions in the plasma channel.

The first section (upstream of the powder supply) is adapted to heat the plasma flow and its characteristics are such that it can provide efficient and fast heating of the powder across the sectional area of the channel. Preferably, the total length of all electrodes in the section is enough for the gas to be fully heated, i.e. for the desired temperature profile to be obtained. This significantly reduces the amount of powder that might otherwise stick to the channel walls due to the fact that it is sufficiently heated.

At the second section (downstream of the powder supply) additional energy is supplied initially to compensate for the cooling of the plasma that occurs since the powder is usually introduced in the channel together with a cold carrier gas. Furthermore, the energy supply is controlled at the second section so that the desired properties of the plasma jet are obtained and also so that the powder reaches the velocity and heat level necessary to obtain the required adhesion, structure and porosity in the spray coating.

Preferably, the sections can be caused to bring about different conditions in the plasma channel by at least one of the following parameters differing between said first and second sections: the length of the section, the number of electrodes in the section and the geometry of the plasma channel in the section.

Suitably, a plurality of powder supply means can be provided, each of said powder supply means being arranged between a section of said electrodes located upstream of the means and a section of said electrodes located downstream of the means. This is particularly convenient when more than one kind of powder is supplied for spray-coating purposes. Thus, each powder sort can be supplied separately and the different powder sorts do not have to be mixed up, which ensures the desired ratio between the different powder sorts in terms of the amount supplied.

The number of electrodes in a section can be no less than one. However, the number of electrodes in at least one section is preferably two. This is advantageous for the following reasons: The discharge current in the channel portion of each section has the same value. The centre of the electric arc, along the centre axis of the plasma channel, has a temperature T that is proportional to the ratio of the discharge current I to the diameter d ($T=(I/d)$) of the plasma channel. Consequently, to increase the temperature level in the plasma flow at the end of a section while maintaining a low current level, the cross section of the plasma flow, and thus the cross section of the electric arc that heats the gas, must be reduced. If the cross section of the electric arc is small the electric field strength in the channel has a high value and the voltage of the section can be several times greater than the natural voltage of the plasma for the commonly used types of plasma-generating gas.

If, at the same time, it is necessary to heat a relatively large gas flow in order to effectively heat the powder that is introduced after this section, then the channel must have a relatively great length. The reason for this is that, to reach the same temperature as that at the centre of the electric arc, the heated gas flow must pass a certain length of the plasma channel along the centre axis of the plasma channel, which length corresponds to the heating distance of the gas. If the gas flow increases so does the heating distance of the gas, which means that the length of the plasma channel in the section must be relatively great.

The combination of a small cross section of the channel and a great length thereof in the section thus results in a high field strength over a relatively great distance, which means that, instead of one long electric arc, two shorter, consecutive arcs can be generated. These shorter arcs burn at a lower voltage and do not heat the gas effectively to a high temperature. The problem of dividing the electric arc into shorter arcs is prevented by dividing the section into at least two separate electrodes that are electrically insulated relative to one another. The number of electrodes, as well as the length of each electrode, depend on the desired gas flow level and the gas jet temperature at the end of the section. Thus, the plasma device can be formed with a relatively small diameter of the plasma channel, which results in a low power consumption and low operating currents. This allows low-power spraying to be obtained.

In certain applications it is particularly convenient for the number of electrodes in the section closest to the inlet end of the plasma channel to be at least two, so as to reduce the risk of the electric arc being divided into two shorter electric arcs.

For supplying powder to the plasma channel the powder supply means suitably forms a space that makes an angle of less than 90° with a centre axis of the plasma channel. Suitably, said space can be formed by a projection on the electrode closest upstream of the means, which is arranged at a distance from a recess on the electrode closest downstream of the means.

By inserting the powder at an angle smaller than 90° relative to a centre axis of the plasma channel the powder can be conveyed to the centre of the plasma and there is less risk of it adhering to the channel walls.

Preferably, said projection is conical and forms an angle (α) with the centre axis of the plasma channel, which angle (α) is suitably in the range of 15-25°. Said recess can thus suitably be conical and forms an angle (β) with the centre axis of the plasma channel, which angle (β) is preferably in the range of 17-30°. In this connection, the projection is conveniently arranged at a distance from the recess, in such manner that it is partly inserted therein, whereby the space for introducing powder at an angle to the centre axis of the plasma channel is formed between the projection and the recess. Said space gets a particularly convenient shape if the difference between said angle of the recess and said angle of the projection (β-α) is 1.5° to 5°.

In this way, the powder is introduced in a satisfactory manner in the discharge channel, essentially along its centre line.

Depending on the kind of powder used, it may be introduced through a circular, ring-shaped opening, through a system of holes or tangentially to the cross section of the channel. Tangential insertion causes vortices to occur, which is particularly desirable for certain types of powder.

Suitably, the diameter of the plasma channel in at least one section is greater than the diameter of the plasma channel in the section located upstream of said section. Preferably, the channel diameter of consecutive sections increases, so that the diameter of the plasma channel in one section is greater than the diameter of the plasma channel in every section located upstream of said section. This is advantageous since each time powder and carrier gas are supplied the flow through the plasma channel increases. To prevent the velocity in the channel from increasing with the increased flow, which would reduce the heating time for the plasma and the powder, it is therefore convenient to increase the diameter of the plasma channel.

As the greatest electric field strength is produced at the cathode, the length of the electrodes is suitably increased by the distance from the cathode, since the field strength decreases with the distance from the inlet end of the plasma channel. Thus, initially the electrode length is preferably small and increases towards the end of the section. Preferably, at least in one section, the length of the furthest upstream electrode equals the diameter of the plasma channel at said electrode located furthest upstream. Suitably, all electrode lengths can be determined by the formula ln=n× dchannel, where in is the length of electrode n and n is the ordinal number of the electrode in a section, as seen from the inlet end of the plasma channel. dchannel is the channel diameter of electrode n (l1 is the length of the electrode closest to the inlet end of the plasma channel, whose length equals its diameter, l1=1× dchannel).

Suitably, the plasma channel is formed by annular electrodes, which advantageously can be coaxially arranged.

The invention further concerns a method of plasma-spraying a powdered material by using a plasma-spraying device comprising electrodes, which form a plasma channel having an inlet end and an outlet end. In the method according to the invention, the powdered material is supplied to the plasma-spraying device in at least one supply point located between two sections of said electrodes, which sections are located respectively upstream and downstream of the supply point.

The advantages of the present invention over prior art correspond to the ones described above in connection with the device.

Preferably, the section located upstream of the supply point is used to bring about the necessary conditions in the plasma flow. Furthermore, the section located downstream of the supply point is suitably used to control the heating of the powdered material and other properties of the powder.

Finally, the invention concerns the use of a device according to the invention for incinerating a powdered material. When incinerating a powdered material, the material is supplied to the device, in which the plasma is used to incinerate the powdered material or transform it into new substances. This is used in particular to incinerate or transform materials that are harmful to the environment or otherwise harmful materials.

In this kind of incineration, besides the powdered material to be incinerated, additional powdered material may conveniently be supplied for neutralisation or transformation of the powdered material intended to be incinerated. Suitably, the additional material is supplied through a material supply means other than the one used for the material to be incinerated.

The excellent possibilities for influencing the characteristics in the plasma channel of the device according to the present invention makes it particularly suitable for incinerating various types of material.

BRIEF DESCRIPTION OF THE DRAWINGS

The invention will be described in more detail below with reference to the accompanying schematic drawings, which by way of example illustrate currently preferred embodiments of the invention.

DESCRIPTION OF PREFERRED EMBODIMENTS

Figure 1:
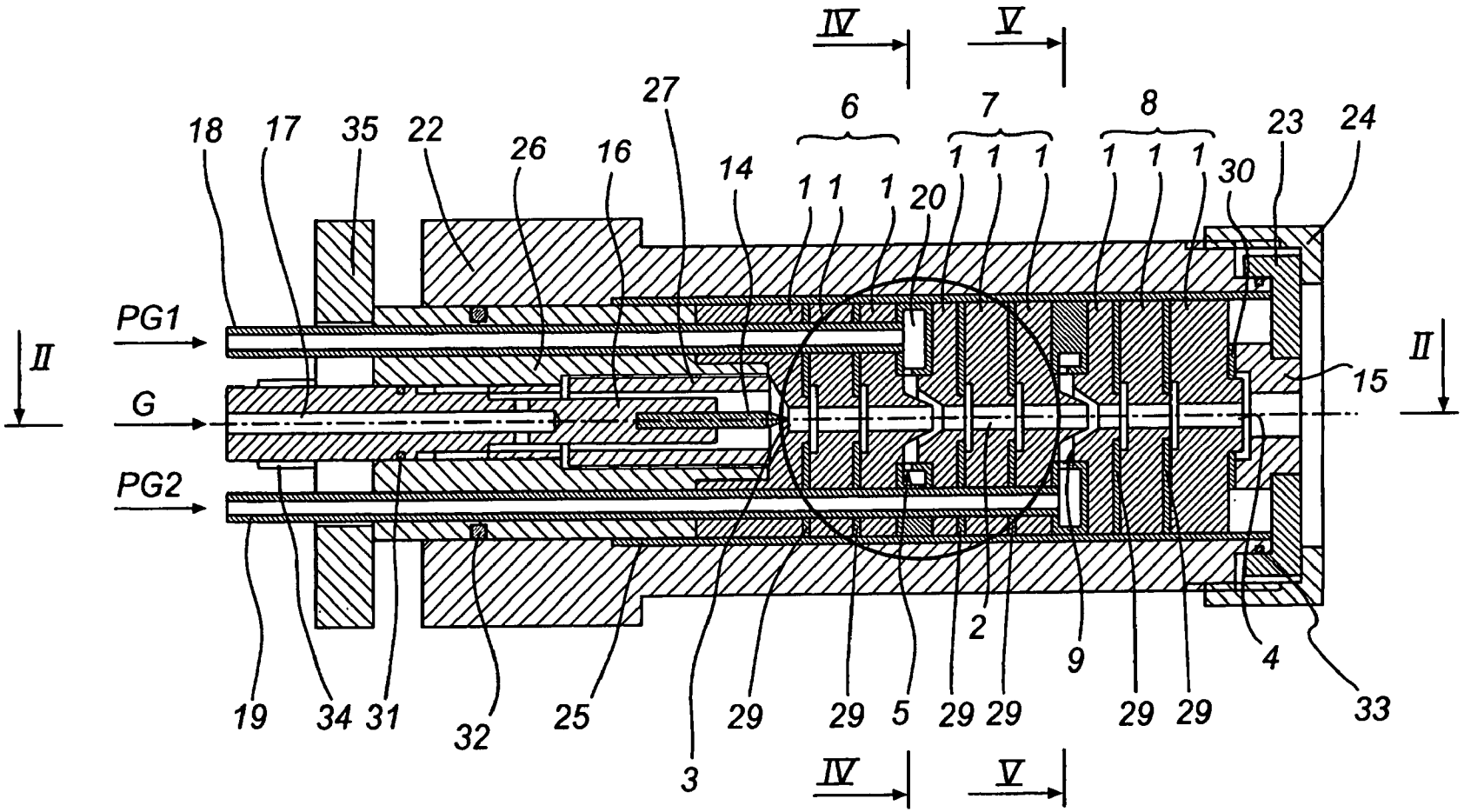
FIG. 1 is a sectional view of a first embodiment of a plasma-spraying device according to the invention with two powder supply means.

FIG. 1 illustrates one embodiment of a plasma-spraying device according to the invention comprising a cathode 14, preferably made of tungsten containing lanthanum, which is arranged in a cathode holder 16. The cathode holder 16 has an internal channel 17 which acts as a means for supplying plasma-generating gas G and as a cooler for the cathode holder 16. The device further comprises a number of coaxially arranged annular electrodes 1, which form a plasma channel 2. The plasma channel 2 extends from the cathode 14 at its inlet end 3 to an anode 15 at its outlet end 4. In use, an electric arc is generated in the device between the cathode 14 and the anode 15, which arc heats the plasma-generating gas to form a plasma. The internal channel 17 of the cathode holder thus opens into the inlet end 3 of the plasma channel, from where plasma will flow through the channel to the outlet end 4 of the plasma channel located adjacent the anode 15, where it is discharged.

A first means 5 for supplying a first powdered material PG1 is arranged between a first section 6 of electrodes 1 located upstream of the supply means 5 and a second section 7 of electrodes 1 located downstream of the supply means 5. Furthermore, a second means 9 for supplying a second powdered material PG2 is arranged between said second section 7 and a section 8 of electrodes 1 located downstream thereof.

The first section 6 is used to heat the plasma-generating gas G, which is supplied through the channel 17. The number of electrodes in this section 6 is determined on the basis of the desired heating of the gas flow; it here comprises three electrodes 1.

The second section 7 is used partly to influence the plasma-generating gas in a suitable manner prior to the introduction of the second powdered material PG2, partly to give the first powdered material PG1 suitable characteristics. The second section 7 here comprises three electrodes 1.

Finally, the third and, in this case, last section 8 is used to give both the powdered materials PG1 and PG2 suitable properties for spraying on a surface to be coated from the anode 15 of the plasma spraying device. In this case, the third section 8 comprises three electrodes 1 as well.

Thus, in this case there are at least two electrodes 1 in each section 6, 7, 8, which reduces the risk of double arcs being generated in the section.

Figure 7:
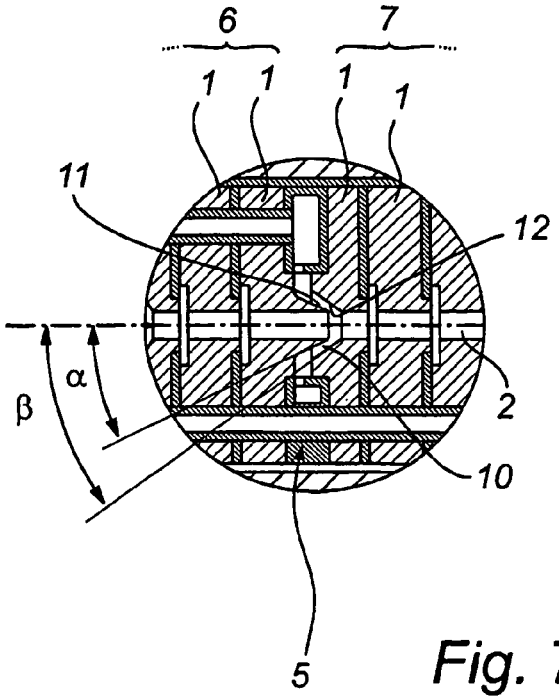
FIG. 7 illustrates a portion of FIG. 1.

The powdered materials PG1 and PG2 are suitably supplied through respectively the first 5 and the second 9 powder supply means each by means of a stream of cold carrier gas through respectively a first 18 and a second 19 supply pipe. The powder supply means 5, 9 are preferably designed in such manner that the last, furthest downstream electrode 1 in the section 6 located upstream of the means has a projection 11, which here is conical and forms an angle $\alpha$ with the centre axis of the plasma channel (see FIG. 7). The first, furthest upstream electrode 1 in the section 7 located downstream of the means 5 has a recess 12, which here is conical and forms an angle $\beta$ (see FIG. 7) with the centre axis of the channel. Suitable angles are 15-25° for $\alpha$ and 17-30° for $\beta$. The term conical is used here in the general sense; as shown in FIG. 1 the shape is that of a truncate cone. This shape facilitates an even supply of the powder to the plasma flow.

The projection 11 is partly inserted in the recess 12, but arranged at such a distance therefrom that a powder supply space 10 is formed between the projection 11 and the recess 12, which space 10 forms an angle with the centre axis of the plasma channel 2.

An expansion chamber 20 is provided which is connected with the space 10 associated with the first supply means 5 and to which the powder material PG1 and its carrier gas are supplied. The powder is introduced in the plasma channel through openings 13 (see FIG. 4*a*). An even distribution of the powder in the channel is here obtained by supplying the powder-transporting gas through the openings 13, which form grooves oriented at an angle to radii of the plasma channel 2. This type of supply is here called tangential supply, since it takes place tangentially to the cross section of the channel, and is used to create vortices in the powder when it is introduced into the channel 2. According to a second embodiment (FIG. 4*b*), powder-transporting gas is supplied to the plasma channel 2 via a small, circular, ring-shaped opening 13'.

Similarly, an expansion chamber 21 is provided which is connected with the other space associated with the second supply means 9. In this case, powder-transporting gas is supplied through a system of evenly distributed holes 13" in a circle, which are drawn along radii of the plasma channel 2 (FIG. 5).

Figure 4A:
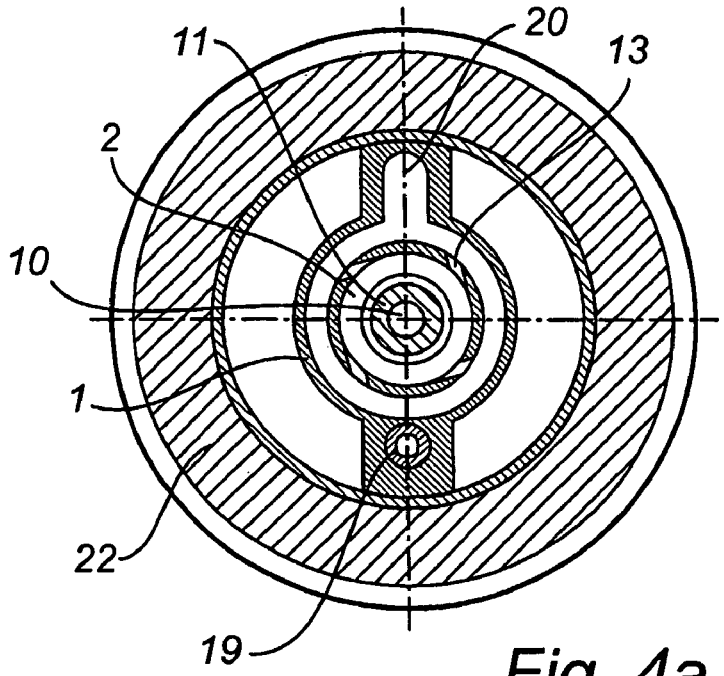
FIGS. 4*a* and 4*b* illustrate two variants of the supply means along the section IV-IV in FIG. 1.
Figure 4B:
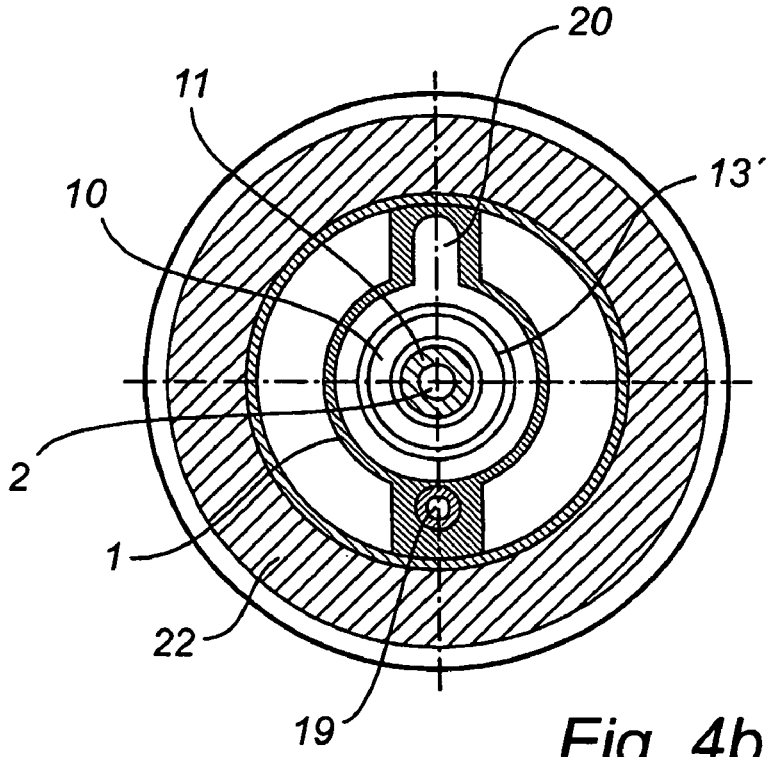
Figure 5:
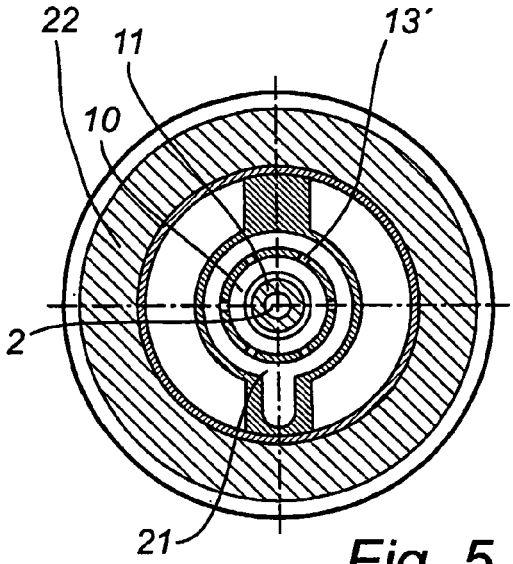
FIG. 5 illustrates a third variant of the supply means along the section V-V in FIG. 1.
Figure 6:
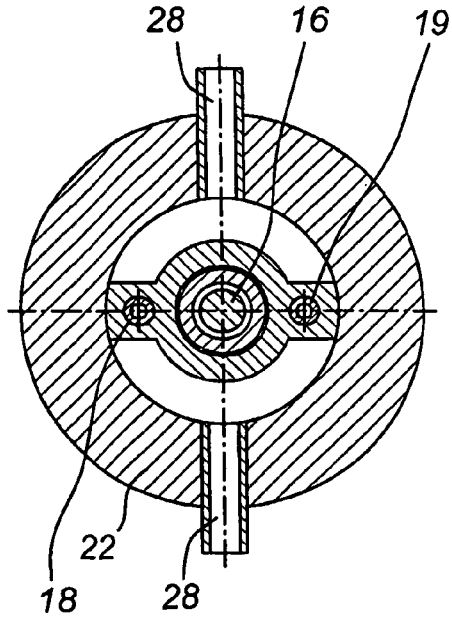
FIG. 6 is a cross-sectional view along the line VI-VI in FIG. 2.

It goes without saying that the formation of openings 13 according to one of the embodiments shown in FIGS. 4*a*, 4*b* and 5 can be varied between the different supply means 5, 9, as required.

Figure 2:
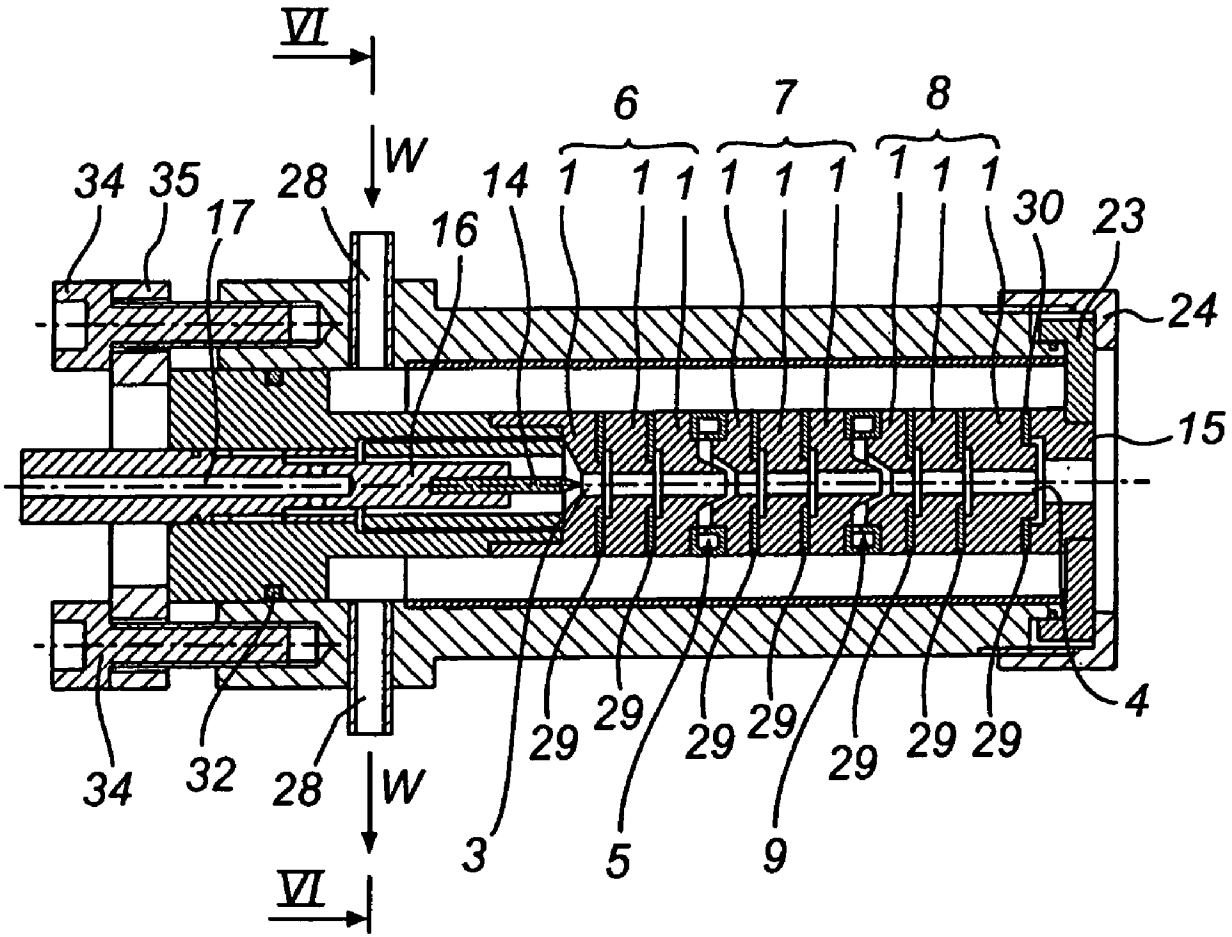
FIG. 2 is a sectional view of the embodiment in FIG. 1 along the line II-II.

More specifically, the plasma-spraying device comprises a conductive cylindrical body 22, on which an anode 15 is arranged by means of a conductive washer 23 and nut 24. The body 22 contains a dielectric casing 25. The cathode holder 16 and the first electrode 1 in the first section 6 are arranged in a second dielectric casing 26. To protect the casing 26 from the heat a ceramic casing 27 is used. To cool the plasma-spraying device the body 22 has channels 28 (see FIG. 2) through which a coolant W is supplied to the anode 15. On the way the electrodes 1 are also cooled. The electrodes 1 are interconnected by means of insulated, watertight gaskets 29. In addition, an anode seal 30 is provided, which may be of the same material as that used for the watertight gaskets 29. A water- and gastight seal is ensured at the moving contact surfaces by means of sealing rings 31, 32, 33. The sealing force is obtained by means of screws 34 and a washer 35. The screws 34 are further connected to the positive pole of the power source of the plasma-spraying device. The negative pole of the power source is connected to the cathode holder 16. The main part of the plasma-generating gas G is supplied through the channel 17 in the cathode holder 16. Powder and powder-transporting gas are supplied through supply pipes 18, 19 to the respective powder supply means 5, 9.

When using the embodiment of the device shown in FIG. 1 plasma-generating gas G is first introduced in the plasma-spraying device through the channel 17 to the plasma channel 2. At the same time a coolant W is supplied through the cooling channels 28 to ensure cooling of the plasma-spraying device. A high voltage triggering system is then switched on, which initiates a discharge process in the plasma channel 2 of the plasma-spraying device and ignites an electric arc between the cathode 14 and the anode 15. Transporting gas PG1 and PG2 is then supplied through the supply pipes 18, 19, following which the powder supply is initiated through the supply means 5, 9.

To switch off the device, the supply of powder is first turned off. The operating current is then turned off and, after a certain time, the supply of the transporting gas and the plasma-generating gas is stopped and, finally, the cooling system is turned off.

When optimal conditions apply it is possible to use the same power source for a set of different plasma-spraying devices which are used for plasma-spraying a plurality of different coatings, such as ceramics, materials with high melting point, materials with low melting point, wear-resistant materials, etc. If argon is used as plasma-generating gas it is suitable for the power source to have a stable operating current of 10-40 A when the operating voltage of the plasma-spraying device is 40-80 V. The operating voltage of the plasma-spraying device depends on the number of sections and the lengths thereof. At a gas consumption of 1-4 l/min and a heating temperature of 8000-12000° C. the channels have a diameter of preferably 1-2 mm. The effect of the plasma flow at the end of the first section at this temperature level is determined by the length of the section, and to eliminate the risk of a double electric arc being created the number of electrodes in the section should be no less than two.

Figure 3:
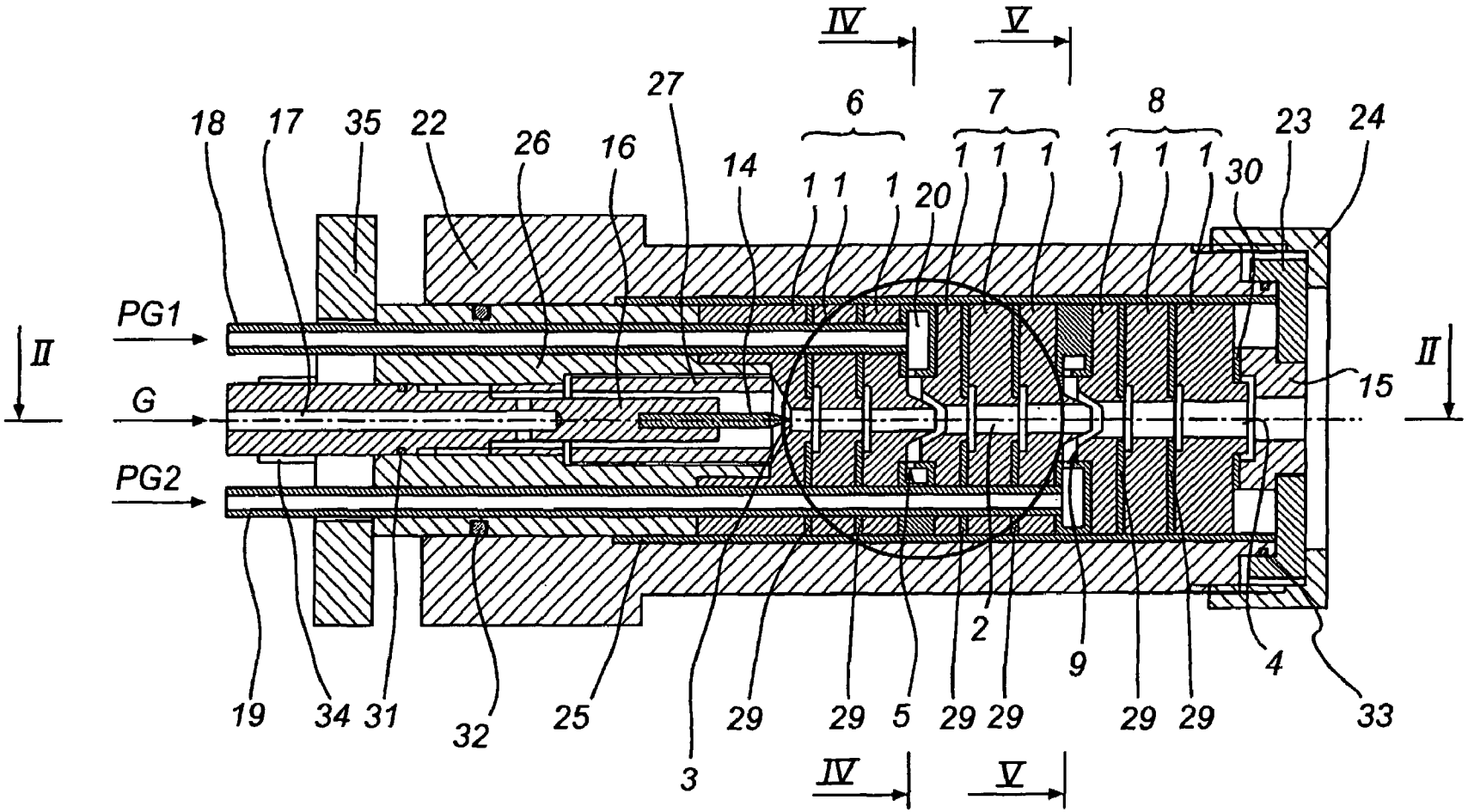
FIG. 3 is a sectional view of a second embodiment of a plasma-spraying device according to the invention, in which the cross section of the channel increases for each section with the distance from the cathode.

FIG. 3 shows a further embodiment of a plasma-spraying device according to the invention. The parts thereof that have equivalents in the embodiment initially described, illustrated in FIG. 1, have been provided with the corresponding reference numerals, and for a description thereof reference is made to the above description of the first embodiment.

The embodiment shown in FIG. 3 differs from the embodiment shown in FIG. 1 as regards the geometry of the plasma channel 2. In this case, the diameter of the plasma channel 2 increases with every section 6, 7, 8, i.e. in such manner that the every consecutive section has a greater diameter than the previous section. This design reduces the risk of the powder material sticking to the inner walls of the plasma channel. Preferably, the diameter here increases according to the formula stated above.

In general, the diameter of the channel greatly influences the velocity of the powder particles. Since the properties of the formed coatings largely depend on the velocity when contact is made with the surface to be coated, the channel diameter can conveniently be varied to obtain the desired effect. Another property that greatly influences the properties of the formed coatings is the temperature of the powder, which likewise, as described above, can be appropriately regulated in the device according to the invention. To sum up, it is possible to control both these properties by choosing suitable parameters, such as length and channel diameter of the section located upstream of the powder supply and the section located downstream of the powder supply.

It will be appreciated that a number of modifications of the embodiment described above are conceivable within the scope of the invention, as defined by the appended claims. As described above, for example, each section may thus instead comprise two or more than three electrodes. Furthermore, it is not necessary to have the same number of electrodes in each section. Finally, the geometry of the plasma channel may vary.

The invention claimed is:

1. A plasma-spraying device for spraying a powdered material, comprising electrodes, which form a plasma channel having an inlet end and an outlet end, and means for supplying said powdered material to said plasma channel, wherein said powder supply means is arranged between a first section of said electrodes located upstream of the means and a second section of said electrodes located downstream of the means, as seen in the direction of plasma flow of the plasma channel, and wherein the diameter of the plasma channel in at least one section is greater than the diameter of the plasma channel in each section located upstream of said section.

2. A plasma-spraying device as claimed in claim 1, wherein at least one of the following parameters is different between said first and second sections: the length of the section, the number of electrodes in the section and the geometry of the plasma channel in the section.

3. A plasma-spraying device as claimed in claim 1, wherein an additional powder supply means is arranged between a third section of electrodes and one of said first and second sections.

4. A plasma-spraying device as claimed in claim 1, wherein a plurality of powder supply means are provided, each of said powder supply means being arranged between a section of said electrodes located upstream of the means and a section of said electrodes located downstream of the means.

5. A plasma-spraying device as claimed in claim 1, wherein the number of electrodes in at least one section is at least two.

6. A plasma-spraying device as claimed in claim 5, wherein the number of electrodes in the section closest to said inlet end of the plasma channel is at least two.

7. A plasma-spraying device as claimed in claim 1, wherein the powder supply means forms a space for supplying powder at an angle to a center axis of the plasma channel.

8. A plasma-spraying device as claimed in claim 7, wherein said space is formed by a projection on the electrode closest upstream of the means, which is arranged at a distance from a recess in the electrode closest downstream of the means.

9. A plasma-spraying device as claimed in claim 8, wherein said projection is conical and makes an angle ($\alpha$) with the center axis of the plasma channel.

10. A plasma-spraying device as claimed in claim 9, wherein said angle ($\alpha$) is 15-25°.

11. A plasma-spraying device as claimed in claim 8, wherein said recess is conical and makes an angle ($\beta$) with the center axis of the plasma channel.

12. A plasma-spraying device as claimed in claim 11, wherein said angle ($\beta$) is 17-30°.

13. A plasma-spraying device as claimed in claim 11, wherein the difference between said angle of the recess and said angle of the projection ($\beta$-$\alpha$) is 1.5° to 5°.

14. A plasma-spraying device as claimed in claim 1, wherein the powder supply means comprises openings that are oriented at an angle to the center axis of the plasma channel to obtain a tangential powder supply.

15. A plasma-spraying device as claimed in claim 1, wherein the diameter of the plasma channel in one section is greater than the diameter of the plasma channel in the section located upstream of said section.

16. A plasma-spraying device as claimed in claim 1, wherein the length of the electrodes is increased by their distance from the inlet end of the plasma channel.

17. A plasma-spraying device as claimed in claim 1, wherein at least in one section, the length of the furthest upstream electrode equals the diameter of the plasma channel in said furthest upstream electrode in said section.

18. A plasma-spraying device as claimed in claim 1, wherein at least in one section, the diameter of the plasma channel varies in said section.

19. A plasma-spraying device as claimed in claim 1, which further comprises a cathode and an anode arranged at a distance from the cathode and coaxial therewith, between which an electric arc is generated, during use of said device, into which gas is introduced to form a plasma, said electrodes being arranged between said cathode and said anode forming said plasma channel.

20. A plasma-spraying device as claimed in claim 1, wherein said electrodes are annular.

21. A plasma-spraying device as claimed in claim 1, wherein said electrodes are coaxially arranged.

22. A plasma-spraying device for spraying a powdered material, comprising electrodes, which form a plasma channel having an inlet end and an outlet end, and means for supplying said powdered material to said plasma channel, wherein said powder supply means is arranged between a first section of said electrodes located upstream of the means and a second section of said electrodes located downstream of the means, as seen in the direction of plasma flow of the plasma channel, and wherein at least in one section, the length of the furthest upstream electrode equals the diameter of the plasma channel in this electrode.

23. A plasma-spraying device as claimed in claim 22, wherein the diameter of the plasma channel in at least one section is greater than the diameter of the plasma channel in each section located upstream of said section.

24. A plasma-spraying device as claimed in claim 22, wherein in one section, the length of the electrodes in the section, which are located downstream of said furthest upstream electrode, is calculated as $$Ln=n\times dchannel$$

where Ln is the length of electrode n, n is the ordinal number of the electrode in a section and dchannel is the diameter of the plasma channel in said electrode n.

25. A method of supplying a powdered material by using a plasma-spraying device comprising electrodes, which form a plasma channel having an inlet end and an outlet end, comprising:

supplying the powdered material to the plasma-spraying device in at least one supply point located between two sections of said electrodes, which sections are located respectively upstream and downstream of the supply point, wherein the diameter of the plasma channel is adapted in at least one section to be greater than the diameter of the plasma channel in each section located upstream of said section.

26. A method of supplying a powdered material as claimed in claim 25, wherein the section located downstream of the supply point is used to control the heating of the powdered material and other properties of the powder.

27. A method of supplying a powdered material as claimed in claim 25, wherein at least one of the following parameters is different between said sections located respectively upstream and downstream: the length of the section, the number of electrodes in the section and the geometry of the plasma channel in the section.

28. A method as claimed in claim 25, wherein a powdered material is supplied in at least two supply points located between the two sections of said electrodes, which sections are located respectively upstream and downstream of the respective supply points.

29. A method of supplying a powdered material by using a plasma-spraying device comprising electrodes, which form a plasma channel having an inlet end and an outlet end, comprising:

supplying the powdered material to the plasma-spraying device in at least one supply point located between two sections of said electrodes, which sections are located respectively upstream and downstream of the supply point, wherein at least in one section, the length of the furthest upstream electrode is ad to equals the diameter of the plasma channel in this electrode.

* * * * *